United States Patent [19]

Punako et al.

[11] 4,415,213

[45] Nov. 15, 1983

[54] HERMAPHRODITE ELECTRICAL CONNECTOR

[75] Inventors: Stephen Punako; David W. MacAvoy, both of Bainbridge, N.Y.

[73] Assignee: The Bendix Corporation, Southfield, Mich.

[21] Appl. No.: 317,210

[22] Filed: Nov. 2, 1981

[51] Int. Cl.[3] ..... H01R 13/625

[52] U.S. Cl. ..... 339/49 R; 339/90 R

[58] Field of Search ..... 339/47 R, 49 R, 89 R, 339/89 C, 89 M, 90 R, 90 C, DIG. 2

[56] References Cited

U.S. PATENT DOCUMENTS

| | | | |
|---|---|---|---|
| 2,264,687 | 12/1941 | Winkler et al. | 339/188 |
| 3,165,340 | 1/1965 | Kuehl et al. | 339/89 M |
| 3,478,302 | 11/1969 | Chirumbolo | 339/90 R |
| 3,665,371 | 5/1972 | Cripps | 339/90 C |
| 3,745,511 | 7/1973 | Fussell | 339/49 |
| 3,808,580 | 4/1974 | Johnson | 339/89 R |
| 4,204,740 | 5/1980 | Krolak | 339/90 R |

*Primary Examiner*—John McQuade

*Attorney, Agent, or Firm*—John R. Benefiel; Raymond J. Eifler

[57] ABSTRACT

An improved hermaphrodite electrical connector (10) of the type including side by side pin connector (16) and socket connector (12), projecting from a base plate (18), and carrying a coupling ring lever assembly (22) for joining the mating connectors, in which the connector shells (32, 34) are integral with base plate, and the coupling ring (26) and lever (24) are also integrally formed. Various means including stops (58) prevent over-compression of a wave washer (52) used to friction load the coupling ring-lever assemblies (22).

1 Claim, 8 Drawing Figures

HERMAPHRODITE ELECTRICAL CONNECTOR

This invention concerns electrical connectors and more particularly electrical connectors of the so-called "hermaphrodite" type. That is, the type which is neither male nor female such that any connector can be mated with any other of similar design. Typically, electrical connectors are designed to be either male or female, i.e., either of a plug or a receptacle configuration which can only be coupled with the opposite type. There are situations where this polarization of the connector configuration creates problems, as in seismic work in which cables are strung out for considerable distances over the ground and connected and reconnected as the seismic exploration is carried out in such a way that the orientation of the cable ends is shifted. For such application, so-called "hermaphrodite" connectors have been developed in which any connector may be joined to any other connector of the same design.

This invention is concerned with improvements to a particular type of hermaphrodite connector as described in U.S. Pat. No. 3,745,511 issued on July 10, 1973 for a Multiconductor Cable Connector. The connector according to that patent includes paired male and female connectors, each including a shell mounted to a base plate, which in turn is mounted to a connector housing or enclosure in which are disposed the cable leads. One of the connector shells has associated with it a lever and coupling ring which is rotatable on the connector shell and has a cam thread adapted to engage a bayonet projection on the mating connector shell such as to draw the connectors into engagement. The mating hermaphrodite connector has a similar lever and ring such that each is adapted to be mated with the other. The levers are simultaneously manipulated during coupling to draw both of the respective male and female connectors into engagement simultaneously.

This design while successfully providing a hermaphrodite connector has several design disadvantages. The paired male and female connectors mounted to the plate are essentially conventional connectors which are mounted to the plate by a relatively complicated and costly arrangement, which includes numerous retainer parts. The lever and coupling ring is also of costly construction inasmuch as it consists of a conventional coupling ring normally employed in coupling the male and female connectors separately attached to the lever arm.

There has also been experienced certain performance problems due to the need for a simultaneous manipulation of the lever arms for proper coupling action. If only one lever arm is manipulated at a time tilting between the paired connectors occurs. In order to maintain a frictional engagement of the coupling ring threads with the bayonet projections a wave spring is employed which exerts a bias tending to perload the cam thread. If only a single lever is manipulated the resultant tilting causes an excessive deflection of the wave spring of the coupled connector which may cause the wave spring to take a set, reducing the spring force generated, and contributing to looseness of the lever arm, which in turn can lead to uncoupling of the connector. Another possibility is excessive travel of the coupling ring which can occur if one of the levers is not appropriately positioned at the start position, i.e. 90° from the fully advanced position, such excessive travel can also cause the wave spring to be over compressed.

The bayonet lug projections are normally provided by separate steel pins which are separately assembled into the connector shells. This not only is a relatively costly manufacturing process, but concentrates the stress and wear of the lug and/or the cam thread on the coupling ring.

DISCLOSURE OF THE INVENTION

The present invention consists of an improved hermaphrodite connector of the type described in which the connector shells are formed integrally with the base plate with the pin and socket connector inserts being mounted within the cast in shells to simplify the connector costruction. This has the advantage of eliminating the numerous retainer parts used in the prior art design as well as simplifying the assembly thereof.

The improved connector also provides a means for minimizing the possibility of damage to the wave spring. This improvement includes, in a first embodiment, a series of stops cast into the coupling ring, within the recess wherein is located the wave spring, which stops limit the compression of the wave spring to prevent the imposition of a set.

In addition, each coupling ring lever is positioned between positive cast-in stops such that over travel of the coupling ring is precluded.

In a second embodiment, the coupling ring is formed with a camming projection mating with a cam thread formed in the exterior of the mating shell.

The coupling ring and lever are also designed of a one piece construction to further simplify the construction of the connector.

Finally, the lugs cooperating with the coupling ring thread are designed as cast-in projections which may be contoured to reduce the stress and wear thereon.

The invention has the advantage of being a much simpler and thus lower cost design due to the improvement in the connector shell and coupling ring and lever constructions. The field problem which has heretofore been encountered of over stressing the wave washer is also eliminated such that the invention has the advantage of improved reliability.

DETAILED DESCRIPTION OF THE DRAWINGS

Figure 1:
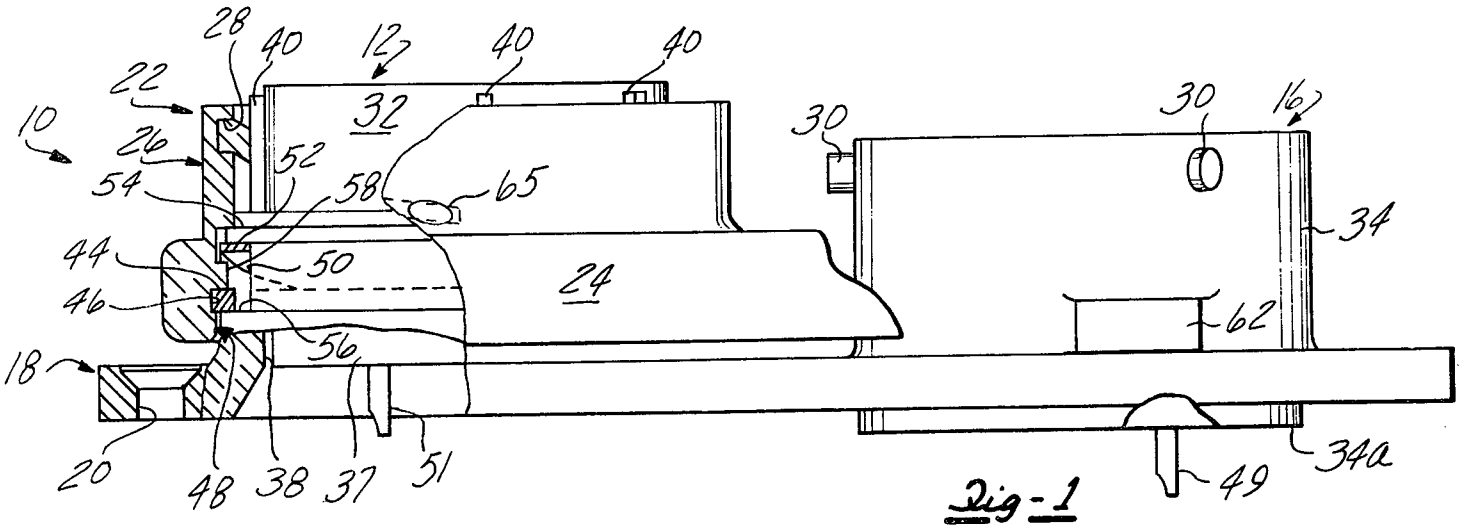
FIG. 1 is a side elevational view in partial section of an electrical connector according to the present invention.

Referring to the drawings, and particularly FIG. 1 the hermaphrodite connector 10 according to the present invention includes a paired socket connector 12 and a pin connector 16, both carried by a shell-base plate 18 which is adapted to be mounted as with machine screws and mounting holes 20 to a junction box (not shown).

The socket connector 12 has received over its outside diameter, a lever coupling ring assembly 22 which includes a lever arm 24 and a coupling ring 26. The coupling ring 26 is formed with an internal cam thread 28 which is adapted to cooperate with a series of lugs 30, secured to the pin connector 16 exterior.

Thus, each such connector 10 may be mated with a similarly configured hermaphrodite connector with the coupling ring 26 of each connector engaging the pin connector 16 of the other mating electrical connector.

According to the concept of the present invention, there is provided a common connector "shell" consisting of an integral shell-base plate 18, having side-by-side, each generally cylindrical socket connector shell 32, and pin connector shell 34 extending from one side thereof. Pin connector shell includes a rim portion 34 *a* extending a short distance from the other side of the base plate 18. A pin insert 36 is secured in position within the connector shell 34 and a socket insert 37 mounted within the socket shell 32 as by an epoxy bond as indicated at 38. Other known mounting and sealing means such as a mechanical connection with a sealing ring could of course be used.

The integral shell-base plate construction eliminates the numerous parts which were required under the prior art practice and greatly simplifies its assembly in reducing the cost of the part, since this part may be die cast, investment cast, exruded, molded, etc. as a single part. The shell-base can be constructed of metal, a high strength plastic, or other suitable material.

This construction also includes cast in bayonet projections 30, keys 40, and corresponding grooves 42, on the pin connector shell 36 and the socket connector shell 34, although the keys 40 and grooves 42 may be eliminated in this design.

In a similar fashion the coupling ring lever assembly 22 is constructed as a one part piece, as by forging, die casting, extruding, etc., combining the coupling ring 26 and lever 24 to further simplify the construction as shown in FIG. 1. The coupling ring lever assembly 22 is maintained on the socket connector shell 32 by means of a split snap ring 44 carried by the coupling ring, disposed in a recess 46 on an interior of a bore 48 formed on the interior of the coupling ring 26. The inside of the snap ring 44 extends to an annular recess 50 is provided in the exterior of the shell 32, with a wave washer 52 disposed therein positioned between a flange 54 and the snap ring retainer 44. The snap ring retainer 44 in turn sets atop a shoulder 56 formed on the socket shell 32 and defining in part recess 50. The wave washer 52 thus acts to axially bias the coupling ring 26 and socket shell 32 to enable frictional positioning of the levers 24.

According to one aspect of the present invention, a series of plug stops 58 are provided which are interposed between the waves of the wave washer 52, such that the axial space between the stops 58 and the wave washer 52 is limited to that just corresponding to full normal compression of the wave washer 52. Thus, any incidence of tilting which tends to overcompress the wave washer 52 will be countered by the presence of the stops 58 bottoming out on the wave washer prior to deflection sufficient to cause it to take a set. The stops are preferably cast in as shown in FIG. 1.

Figure 2:
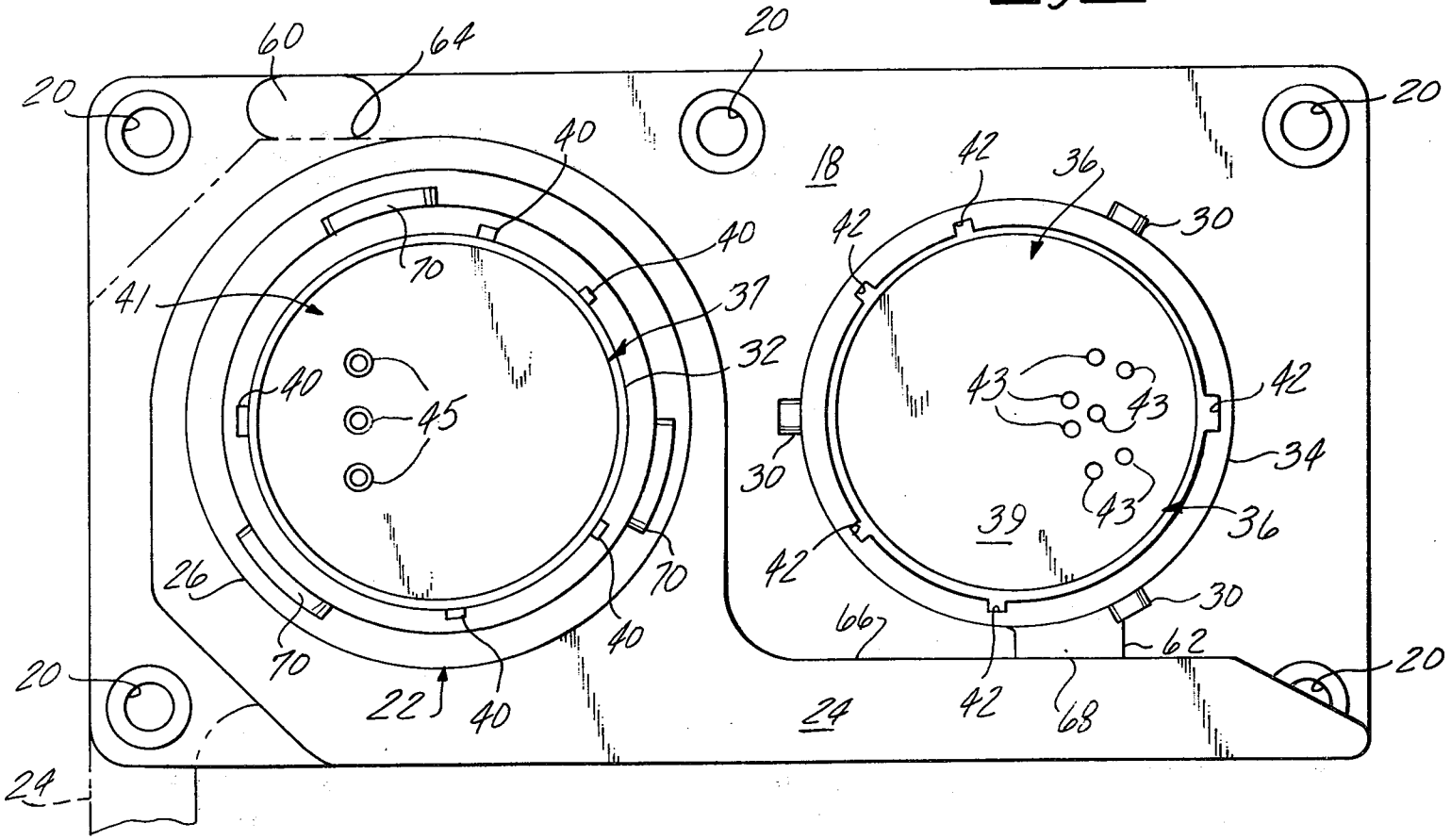
FIG. 2 is a plan view of the electrical connector shown in FIG. 1.

FIG. 2 shows a pair of positive stops, an "open" stop 60 cast integrally with the base plate 18 adjacent the socket shell 32 and a "closed" stop 62, cast integrally to the pin shell 34.

The lever 24 is provided with an outer flat 64 which moves into abutment with the open stop 60 with the lever in the fully open position, as shown in phantom in FIG. 2. The forward inside surface 66 moves into abutment with the outer face 68 of the closed stop 62.

Accordingly, the motion of the lever-coupling ring assembly 22 is constrained between the proper full open position and the proper full closed position, to minimize the possibility of overtightening the wave washer due to starting the cam thread 28 so as to result in excessive travel.

The cam thread 28 is provided with upper openings 70 which allow for the receiving of the bayonet lugs 30 with the lever coupling ring 22 in its fully open position such that with both levers 24 in a fully open position the opening 70 will be properly aligned in the respective connectors.

A series of openings 65, one of which is shown in FIG. 1, are provided in the coupling ring 26 wall, enabling viewing of the projections 30 in the fully closed position. These also act as detents as the projections 30 move thereinto. For this latter purpose, the transverse diameter is slightly greater than the width of the cam thread 28.

FIG. 2 illustrates that each of the inserts, pin insert 36 and socket insert 37, includes a pin insert body 39 and a socket insert body 41, respectively, and a series of pin contacts 43 and socket contacts 45, respectively, each adapted to be interfit with the corresponding contacts of the mating connector. Each of the pin contacts are electrically connected to terminal portions 49 at the rear of the connector body 39, terminals 49 and socket contacts 45 being electrically connected to terminals 51. These details are of conventional design.

Figure 3:
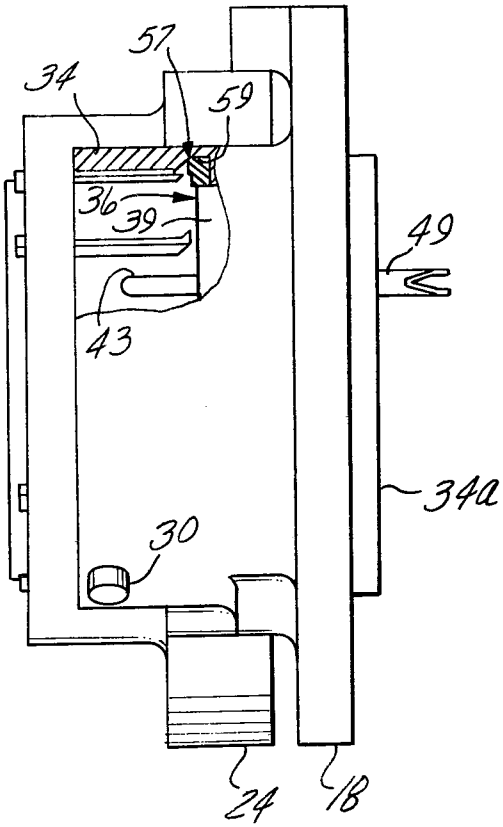
FIG. 3 is an end-wise partially sectional view of the electrical connector shown in FIGS. 1 and 2.

FIG. 3 shows a sealing arrangement consisting of a gasket 57 which is disposed in a recess 59 machined into the interior of the pin shell 34 and which is adapted to engage the leading edge of the socket shell 32 upon mating engagement therewith.

Figure 4:
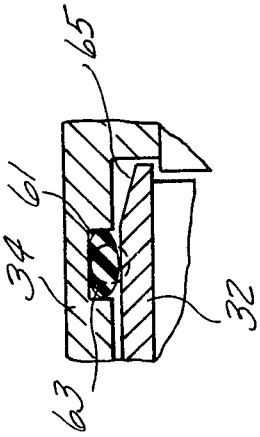
FIG. 4 is a fragmentary and partially sectional view of an alternative sealing arrangement for the electrical connector according to the present invention.

FIG. 4 depicts an alternative arrangement, with the plug shell 34 formed with a side recess 61 within which is disposed an O-ring type seal 63. The leading edge of the receptacle shell 32 is tapered at 65 to assist compression of the seal 62. This arrangement is provided for connector designs in which the keys 40 and keyways 42, respectively, are omitted; such keys and keyways not being necessary for the hermaphrodite connector according to the present invention.

Figure 5:
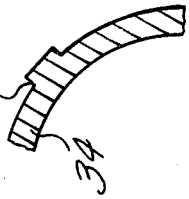
FIG. 5 is a fragmentary sectional view of the connector shell showing a lug feature according to the present invention.

FIG. 5 shows the bayonet projections 30 formed integrally with the plug shell 34 to thereby eliminate the need for a separate machining and assembly operations and further simplify and lower the cost of the design.

Figure 6:
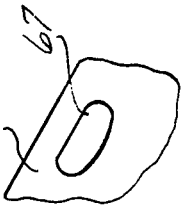
FIG. 6 is a fragmentary end view of the lug configuration shown in FIG. 5.

FIG. 6 reveals that the casting-in process may also allow an elongate shaped bayonet projection 67. This shape reduces stress concentration as well as the tendency for wear by the increased contact area between the bayonet projection 67 and the cam thread 28.

Figure 8:
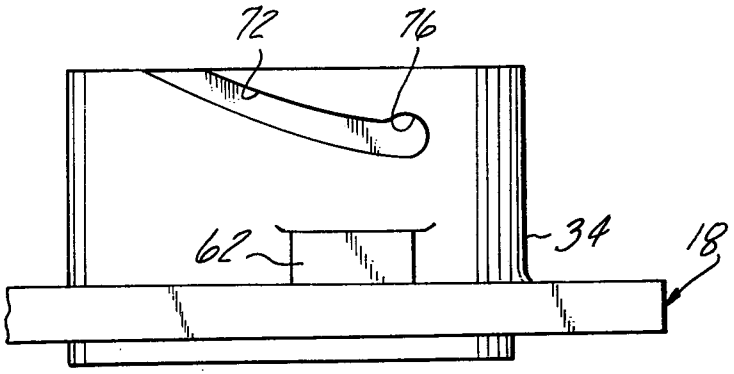
FIG. 8 is a fragmentary sectional view of an alternate configuration of a coupling ring to be used with the base-shell shown in FIG. 7.
Figure 7:
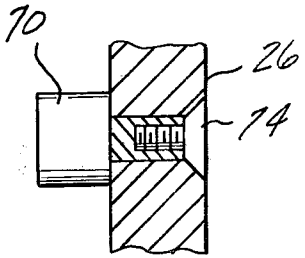
FIG. 7 is a fragmentary front view of an alternative embodiment of the shell-base component used in the hermaphrodite electrical connector according to the present invention.

FIGS. 7 and 8 depict an alternative construction of the mating portions of the coupling ring 26 and the shell 34. In this improvement, the coupling ring 26 is formed with a projections 70 adapted to mate with a cam thread 72 formed on the pin shell 34. The projections 70 may be retained with recessed screws 74. The cam thread 72 may be provided with a detent drop 76 into which the projections 70 move in the fully closed position.

It can be appreciated that the present invention achieves the advantages as set forth above in that a much simplified structure is afforded by the integral construction of the connector shells and the levers and coupling rings as well as the bayonet projections. In addition the damaging of the wave washer in such design is substantially precluded by the arrangements disclosed.

Many variations are of course possible as for example only one of the plug or receptacle shells may be cast integral with the base plate and a separate shell provided if casting accuracy cannot be achieved in a particular operation such that the center to center distance of the shells cannot be held.

The location of the cast stops 60 and 62 can be varied with an appropriate reconfiguration of the coupling ring periphery. For example stop 60 may be located against the pin shell 34, 90° clockwise from stop 62 with a flat formed on the coupling ring 26 moving into abutment therewith upon movement to the full open position of the coupling ring 26.

Having described the invention what is claimed is:

1. In combination with a hermaphrodite electrical connector of the type including a base plate and side-by-side socket and pin connectors, each of said socket and pin connectors including a generally cylindrical connector shell extending from said base plate; a coupling ring received over one of said connector shells, said coupling ring formed with a cam thread adapted to engage a projection carried by a connector carried by a mating hermaphrodite electrical connector; said engagement of said cam thread and said projection producing relative axial travel of said mating connectors on said mating hermaphrodite electrical connectors upon rotation of said coupling ring, to bring said mating connectors into engagement; each of said connector shell and said coupling ring having structure defining an intervening annular recess; an annular wave washer disposed within said annular recess, said wave washer having a series of axially extending waves formed therein disposed engaging said structure of said coupling ring and said connector shell to create a frictional force acting on said coupling ring and said shell to enable frictional positioning of said coupling ring on said connector shell, characterized by a plurality of stops carried by said coupling ring and extending within said recess and interposed between the waves of said wave washer and limiting the relative axial travel to that less than the axial depth of said wave washer whereby overstressing said wave washer is prevented.

* * * * *